US012214982B2

(12) United States Patent
Awaji et al.

(10) Patent No.: US 12,214,982 B2
(45) Date of Patent: Feb. 4, 2025

(54) RECORDING DEVICE AND AIR BLOWING CONTROL METHOD OF RECORDING DEVICE

(71) Applicant: SEIKO EPSON CORPORATION, Tokyo (JP)

(72) Inventors: Shogo Awaji, Shiojiri (JP); Takuya Uehara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 179 days.

(21) Appl. No.: 18/169,399

(22) Filed: Feb. 15, 2023

(65) Prior Publication Data

US 2023/0257223 A1 Aug. 17, 2023

(30) Foreign Application Priority Data

Feb. 16, 2022 (JP) ..... 2022-021893

(51) Int. Cl.
*B65H 29/24* (2006.01)
*B65H 5/22* (2006.01)
(Continued)

(52) U.S. Cl.
CPC ..... *B65H 29/247* (2013.01); *B65H 5/228* (2013.01); *B65H 7/16* (2013.01); *B65H 31/02* (2013.01);
(Continued)

(58) Field of Classification Search
CPC .... B65H 29/24; B65H 29/245; B65H 29/246; B65H 29/247; B65H 31/02; B65H 43/00; B65H 43/02; B65H 43/08; B65H 2406/12; B65H 2406/121; B65H 2406/1211; B65H 2406/122; B65H 2406/1222; B65H 2405/11151; B65H 2511/15; B65H 2511/22; B65H 2511/414; B65H 2513/10; B65H 2515/20; B65H 2515/82;
(Continued)

(56) References Cited

U.S. PATENT DOCUMENTS 11,460,805 B2 * 10/2022 Onishi ..... G03G 15/6552
2017/0036881 A1 * 2/2017 Tokuma ..... B65H 29/14
(Continued)

FOREIGN PATENT DOCUMENTS

JP 2018090378 A 6/2018

*Primary Examiner* — Prasad V Gokhale
(74) *Attorney, Agent, or Firm* — CHIP LAW GROUP

(57) ABSTRACT

A medium discharge unit that discharges a medium subjected to recording by a recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit that blows air from above toward the medium discharged from the medium discharge unit, and a control unit that controls the air blowing unit are included. The control unit can attenuate air blowing by the air blowing unit, based on information of an interval between a preceding medium and a following medium that are to be discharged from a discharge position of the medium discharge unit to the placement unit, when the preceding medium is discharged from the discharge position.

14 Claims, 6 Drawing Sheets

(51) Int. Cl.
*B65H 7/16* (2006.01)
*B65H 31/02* (2006.01)
*B65H 43/00* (2006.01)

(52) U.S. Cl.
CPC .... *B65H 43/00* (2013.01); *B65H 2405/11151* (2013.01); *B65H 2406/1222* (2013.01); *B65H 2511/15* (2013.01); *B65H 2511/22* (2013.01); *B65H 2511/414* (2013.01); *B65H 2515/20* (2013.01); *B65H 2515/82* (2013.01); *B65H 2553/00* (2013.01); *B65H 2601/521* (2013.01); *B65H 2701/1311* (2013.01); *B65H 2701/1313* (2013.01)

(58) Field of Classification Search
CPC ..... B65H 2601/521; B65H 2701/1311; B65H 2701/1313
See application file for complete search history.

(56) References Cited

U.S. PATENT DOCUMENTS

| | | | | |
|---|---|---|---|---|
| 2019/0382227 | A1* | 12/2019 | Sakagami ..... | G03G 15/6552 |
| 2021/0347595 | A1* | 11/2021 | Takano ..... | B65H 31/38 |
| 2023/0278821 | A1* | 9/2023 | Miyazawa ..... | B65H 43/00 270/1.01 |

* cited by examiner

RECORDING DEVICE AND AIR BLOWING CONTROL METHOD OF RECORDING DEVICE

The present application is based on, and claims priority from JP Application Serial Number 2022-021893, filed Feb. 16, 2022, the disclosure of which is hereby incorporated by reference herein in its entirety.

BACKGROUND

1. Technical Field

The present disclosure relates to a recording device and an air blowing control method of a recording device.

2. Related Art

As an example of the related art of a recording device of this type, a recording device described in JP-A-2018-90378 is cited. JP-A-2018-90378 describes that an air blowing unit applies air to, of a medium discharged to an inclined placement surface of a placement unit, positions on both sides in a medium width direction with the central portion of the medium interposed between the positions on both sides. That is, a technique is disclosed in which the medium is pressed against the placement unit so as to suppress curl of a paper sheet that has absorbed ink by air blowing from the air blowing unit. The medium discharged onto the inclined placement surface slips down on the placement surface due to its own weight, and a trailing end of the medium is aligned.

However, in the case of the configuration in which air is blown so as to press the medium against the placement unit as in the above-described related art, when the medium is discharged to the placement unit, in particular, when an interval between a preceding medium and the following medium becomes large, the slipping down may be hindered and stopped in the middle thereof, deteriorating stackability on the placement unit. JP-A-2018-90378 does not disclose that this point has been considered.

SUMMARY

In order to solve the problem described above, a recording device according to the present disclosure includes a recording unit configured to perform recording on a medium, a medium discharge unit configured to discharge the medium recorded by the recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit configured to blow air from above toward the medium discharged from the medium discharge unit, and a control unit configured to control the air blowing unit, wherein the control unit is configured to attenuate air blowing by the air blowing unit, based on information of an interval between a preceding medium and a following medium that are to be discharged from a discharge position of the medium discharge unit to the placement unit, when the preceding medium is discharged from the discharge position.

In addition, an air blowing control method of a recording device according to the present disclosure is an air blowing control method of a recording device, the recording device including a recording unit configured to perform recording on a medium, a medium discharge unit configured to discharge the medium recorded by the recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit configured to blow air from above toward the medium discharged from the medium discharge unit, and a control unit configured to control the air blowing unit, the air blowing control method including accepting, by the control unit, information of an interval between a preceding medium and a following medium that are to be discharged from a discharge position of the medium discharge unit to the placement unit, and attenuating air blowing by the air blowing unit, based on the information of the interval, when the preceding medium is discharged from the discharge position.

DESCRIPTION OF EXEMPLARY EMBODIMENTS

Figure 1:
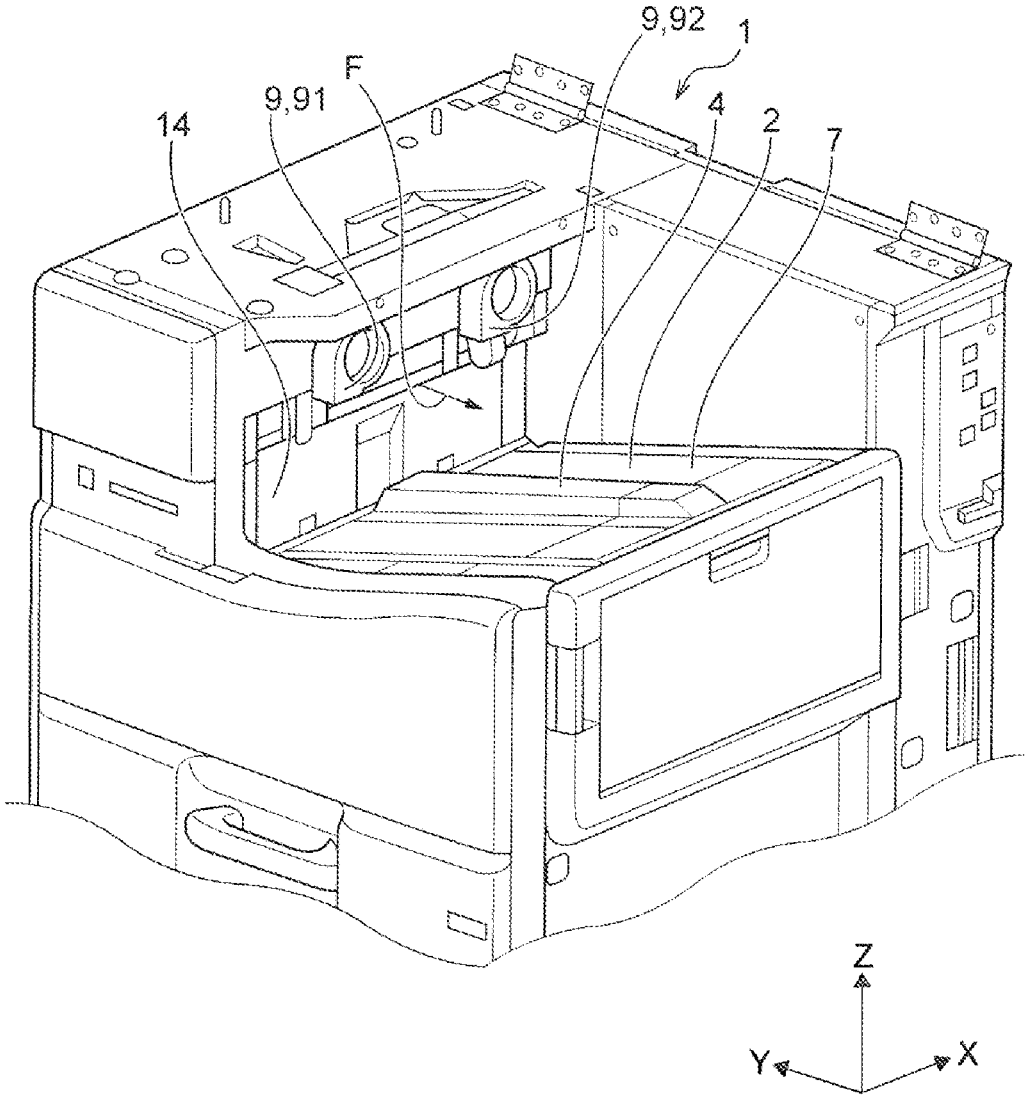
FIG. 1 is a schematic perspective view of a main portion of a recording device according to Exemplary Embodiment 1.

Hereinafter, the present disclosure will be schematically described first.

In order to solve the above problem, a recording device according to a first aspect of the present disclosure includes a recording unit configured to perform recording on a medium, a medium discharge unit configured to discharge the medium recorded by the recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit configured to blow air from above toward the medium discharged from the medium discharge unit, and a control unit configured to control the air blowing unit. Furthermore, the control unit is configured to attenuate the air blowing by the air blowing unit, based on information of an interval between a preceding medium and a following medium that are to be discharged from a discharge position of the medium discharge unit to the placement unit, when the preceding medium is discharged from the discharge position.

Here, "information of an interval" means information that can be used to determine a change in size of the interval between the preceding medium and the following medium that are to be discharged from the discharge position of the medium discharge unit to the placement unit. Thus, all information that can be used to determine a change in size of the interval is included, and is not limited to numerical direct information of an interval D obtained by a sensor or the like. Indirect information such as, for example, flushing that causes the interval D to change, an operation type such as a quiet transport mode, or the like is included.

Furthermore, "attenuating air blowing" includes adjusting an air blowing amount to be less than an air blowing amount before the attenuating, and stopping the air blowing.

The medium discharged from the discharge position of the medium discharge unit drops onto the placement unit due to its own weight. After the medium drops onto a placement surface of the placement unit that is inclined, the medium slips down on the inclined placement surface, and a trailing end of the medium comes into contact with an alignment portion, and a position of the trailing end is aligned. When the medium slips down on the placement surface, the following medium is sent out while being nipped by the medium discharge unit, and a leading end of the following medium passes through an air blowing region of the air blowing unit. In this state, air blown from the air blowing unit is applied to the following medium, and an amount of air applied to the preceding medium that has dropped on the placement unit is reduced. In a state in which the amount of applied air is reduced, the preceding medium slips down on the placement surface due to its own weight.

For example, when the interval between the preceding medium and the following medium that are being transported becomes large due to, for example, a flushing operation being performed in the middle, it may occur that the leading end of the following medium has not reached the air blowing region of the air blowing unit yet while the preceding medium is slipping down on the placement surface. In this case, an amount of air that is applied to the preceding medium does not decrease. When the amount of air that is applied to the preceding medium does not decrease, the preceding medium remains pressed against the placement surface due to the air, and thus, the medium may stop during slipping down. That is, it may occur that the preceding medium cannot slip down on the placement surface. This deteriorates the stackability.

According to the present aspect, the control unit can accept the information of the interval between the preceding medium and the following medium that are discharged from the discharge position to the placement unit, and can attenuate the air blowing by the air blowing unit based on the information of the interval when the preceding medium is discharged from the discharge position. In this way, when the interval is increased to such an extent that the slipping down is hindered, the air blowing is attenuated. Thus, deterioration in stackability due to the slipping down of the preceding medium on the placement surface being hindered can be suppressed.

In a recording device according to a second aspect of the present disclosure, in the first aspect, the control unit stops the air blowing when the interval exceeds a set value.

Here, the set value is determined in advance as an interval for when the air blowing should be stopped. Alternatively, a user may appropriately determine the set value.

According to the present aspect, when the interval exceeds the set value, the control unit stops the air blowing. Thus, the occurrence of the preceding medium being unable to slip down on the placement surface can be more reliably suppressed.

A recording device according to a third aspect of the present disclosure includes, in the first aspect or the second aspect, a medium detection unit positioned upstream of the discharge position in the discharge direction and configured to detect a leading end and a trailing end of the medium.

According to the present aspect, the medium detection unit configured to detect the leading end and the trailing end of the medium is positioned upstream of the discharge position in the discharge direction. This makes it possible to easily obtain the information of the interval by the medium detection unit. Thus, a timing of attenuating the air blowing can be appropriately set.

In a recording device according to a fourth aspect of the present disclosure, in any one of the first to third aspects, the control unit attenuates the air blowing by the air blowing unit when a last medium in a recording job is discharged.

Here, the "last medium" means the last one medium discharged to the placement unit in one recording job.

According to the present aspect, when the last medium is discharged, the air blowing by the air blowing unit is attenuated. In this way, even when the interval until a first medium of the next recording job is discharged becomes large, deterioration in stackability due to the slipping down of the preceding medium on the placement surface being hindered can be suppressed.

In a recording device according to a fifth aspect of the present disclosure, in any one of the first to fourth aspects, the control unit is configured to change a discharge velocity of the medium discharged from the discharge position from a first velocity to a second velocity that is slower than the first velocity, and attenuates the air blowing by the air blowing unit when the medium is discharged at the second velocity.

When the discharge velocity of the medium is changed from the first velocity to the second velocity slower than the first velocity, and then, the medium is discharged, the interval is increased.

According to the present aspect, in this case, the air blowing by the air blowing unit is attenuated. Thus, deterioration in stackability due to the slipping down of the preceding medium on the placement surface being hindered can be suppressed.

In a recording device according to a sixth aspect of the present disclosure, in any one of the first to fifth aspects, the control unit includes a quiet transport mode where quietness is enhanced compared to a normal transport mode for transporting the medium, and the control unit attenuates the air blowing by the air blowing unit when the quiet transport mode is selected.

The quiet transport mode has a slower velocity of transporting the medium than that of the normal transport mode. Thus, the interval is increased.

According to the present aspect, when the quiet transport mode is selected, the air blowing by the air blowing unit is attenuated. Thus, deterioration in stackability due to the slipping down of the preceding medium on the placement surface being hindered can be suppressed.

In a recording device according to a seventh aspect of the present disclosure, in any one of the first to sixth aspects, the recording unit is movable to a recording position where recording is performed on the medium, and a flushing position where flushing is performed, and the control unit attenuates the air blowing by the air blowing unit when the recording unit performs the flushing.

When the recording unit moves to the flushing position to perform flushing, the interval tends to increase. According to the present aspect, when the recording unit performs flushing, the air blowing by the air blowing unit is attenuated.

Thus, deterioration in stackability due to the slipping down of the preceding medium on the placement surface being hindered can be suppressed.

Further, when the recording unit performs flushing, the recording unit moves to the flushing position, and thus, electric power for the movement is required. According to the present aspect, when the recording unit performs flushing, power consumption can be suppressed at the same time because the air blowing by the air blowing unit is attenuated.

In a recording device according to an eighth aspect of the present disclosure, in any one of the first to seventh aspects, the air blowing unit applies air to positions on both sides of the medium in a medium width direction intersecting the discharge direction with a central portion of the medium interposed between the positions on both sides.

When curl is suppressed, the air is preferably applied to both end sides in a width direction of the medium. According to the present aspect, even in such a configuration, deterioration in stackability due to the slipping down of the preceding medium on the placement surface being hindered can be suppressed.

In a recording device according to a ninth aspect of the present disclosure, in any one of the first to eighth aspects, the air blowing unit includes an air blowing direction changing member configured to change a direction in which air is blown to the medium.

According to the present aspect, the direction in which air is blown to the medium can be changed by the air blowing direction changing member. This makes it possible to appropriately change a position where the air is applied according to a size of the medium. Furthermore, the suppression effect of curl can be appropriately adjusted.

In addition, the air blowing direction changing member can be caused to function as a shutter of an air blowing port of the air blowing unit, which allows the air blowing unit to be attenuated.

A recording device according to a tenth aspect of the present disclosure includes, in any one of the first to ninth aspects, a stacking height detection unit installed at a constant height from a placement surface of the placement unit and configured to detect a stacking height of the medium stacked, wherein the stacking height detection unit is provided at a position that is below the discharge position in a vertical height direction and that overlaps, in the discharge direction, an air blowing region where the air blowing unit blows air to the medium.

Here, the "overlapping position" in the expression of "the position overlapping the air blowing region where the air blowing unit blows air to the medium in the discharge direction" means a position where the air blowing region and the stacking height detection unit seem to overlap each other when the recording device is viewed from a direction intersecting the discharge direction. Note that strictness is not required for the extent to which the air blowing region and the stacking height detection unit "seem to overlap each other" as described above, and the air blowing region and the stacking height detection unit may be shifted from each other within a range of preventing erroneous detection by the stacking height detection unit.

According to the present aspect, the stacking height detection unit is provided at a position that is below the discharge position in the vertical height direction and that overlaps the air blowing region where the air blowing unit blows air to the medium in the discharge direction. This allows the medium to be detected at a position where the medium is pressed against the placement unit due to the air from the air blowing unit, that is, a position where curl of the medium is suppressed, so that it is possible to more reliably detect whether the placement unit is full or not.

In a recording device according to an eleventh aspect of the present disclosure, in the tenth aspect based on the third aspect, the stacking height detection unit detects the stacking height of the medium in a predetermined period of time after the medium detection unit detects the trailing end of the preceding medium.

Here, "detecting the stacking height of the medium in the predetermined period of time" means that the medium is detected a plurality of times in the predetermined period of time excluding cases where the medium is instantaneously detected.

The medium discharged from the discharge position of the medium discharge unit passes through the detection region of the stacking height detection unit when the medium drops onto the placement unit, and thus, the stacking height detection unit instantaneously detects "presence" of the medium. However, the detection is not performed by detecting the stacking height of the medium, but is only performed by detecting the passage of the medium, and thus, unless the stacking height detection unit excludes this instantaneous detection, the stacking height detection unit causes erroneous detection in detecting the stacking height.

According to the present aspect, the stacking height detection unit detects the stacking height of the medium in the predetermined period of time after the medium detection unit detects the trailing end of the preceding medium, that is, the detecting period has a sufficient time width, and thus, instantaneous detection such as detecting only the passage of the medium can be excluded, thereby preventing erroneous detection.

In a recording device according to a twelfth aspect of the present disclosure, in the eleventh aspect, the predetermined period of time is from when the medium detection unit detects the trailing end of the preceding medium until when the leading end of the following medium blocks the air blowing unit.

Here, the expression of "until when the leading end of the following medium blocks the air blowing unit" is used to mean any point in time until the leading end of the following medium reaches one end of the air blowing region of the air blowing unit.

The leading end of the following medium blocks the air blowing unit, and thus, pressing the preceding medium by the air blowing unit is attenuated. Thereby, the preceding medium may be curled to some extent or lifted.

According to the present aspect, by setting the predetermined period of time to a period until the leading end of the following medium blocks the air blowing unit, the stacking height can be appropriately detected because the stacking height is detected when the preceding medium is pressed by the air blowing unit.

In a recording device according to a thirteenth aspect of the present disclosure, in the eleventh aspect, the predetermined period of time is longer than the time that it takes for the medium dropping after being discharged from the discharge position of the medium discharge unit to pass through a detection region of the stacking height detection unit.

According to the present aspect, the predetermined period of time is longer than the time it takes for the medium dropping after being discharged from the discharge position of the medium discharge unit to pass through the detection region of the stacking height detection unit, and thus, the erroneous detection can be suppressed.

Further, an air blowing control method of a recording device according to a fourteenth aspect of the present disclosure is an air blowing control method of a recording device, the recording device including a recording unit configured to perform recording on a medium, a medium discharge unit configured to discharge the medium recorded by the recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit configured to blow air from above toward the medium discharged from the medium discharge unit, and a control unit configured to control the air blowing unit, the air blowing control method including accepting, by the control unit, information of an interval between a preceding medium and a following medium that are to be discharged from a discharge position of the medium discharge unit to the placement unit, and attenuating the air blowing by the air blowing unit, based on the information of the interval, when the preceding medium is discharged from the discharge position.

According to the present aspect, an advantageous effect similar to that in the first aspect can be obtained.

Exemplary Embodiment 1

A recording device 1 and an air blowing control method of a recording device according to Exemplary Embodiment 1 of the present disclosure will be described in detail below based on FIG. 1 to FIG. 6. Here, the recording device 1 will be described as an ink jet printer.

In the following description, three axes orthogonal to each other are individually denoted as an X axis, a Y axis, and a Z axis, as illustrated in each of the drawings. A Z-axis direction corresponds to a vertical direction or a direction in which gravity acts. An X-axis direction and a Y-axis direction correspond to a horizontal direction. In each figure, directions indicated by arrows of the three axes (X, Y, Z) are + directions in the respective directions, and the opposite directions thereto are − directions.

Figure 2:
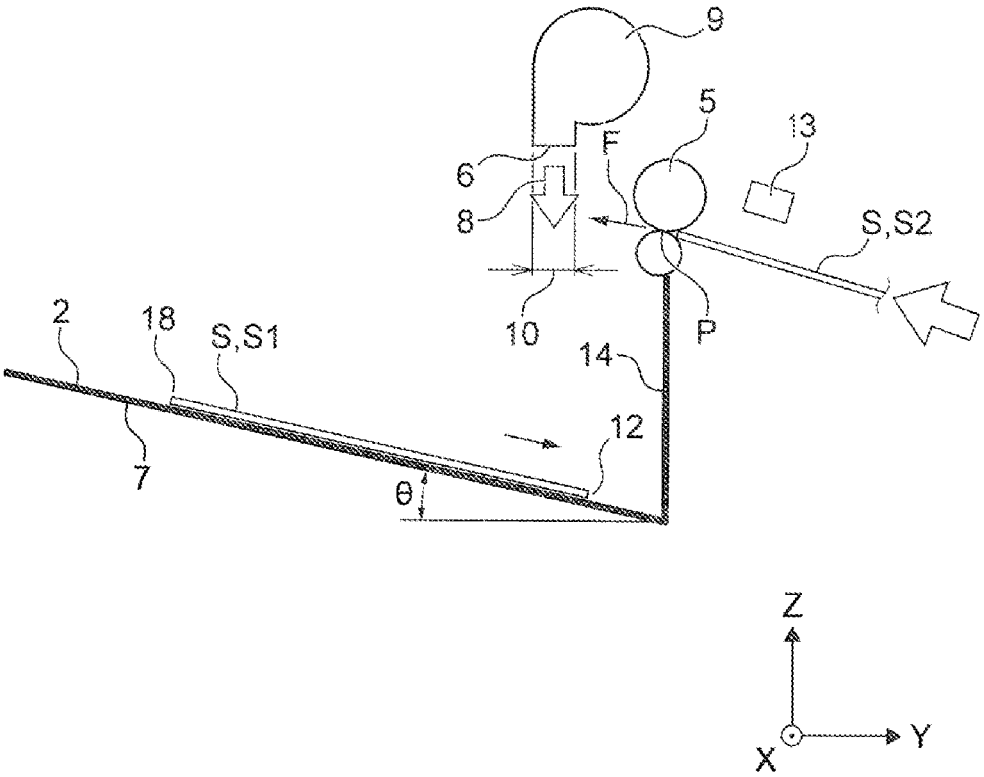
FIG. 2 is an enlarged schematic view of the main portion of Exemplary Embodiment 1.
Figure 3:
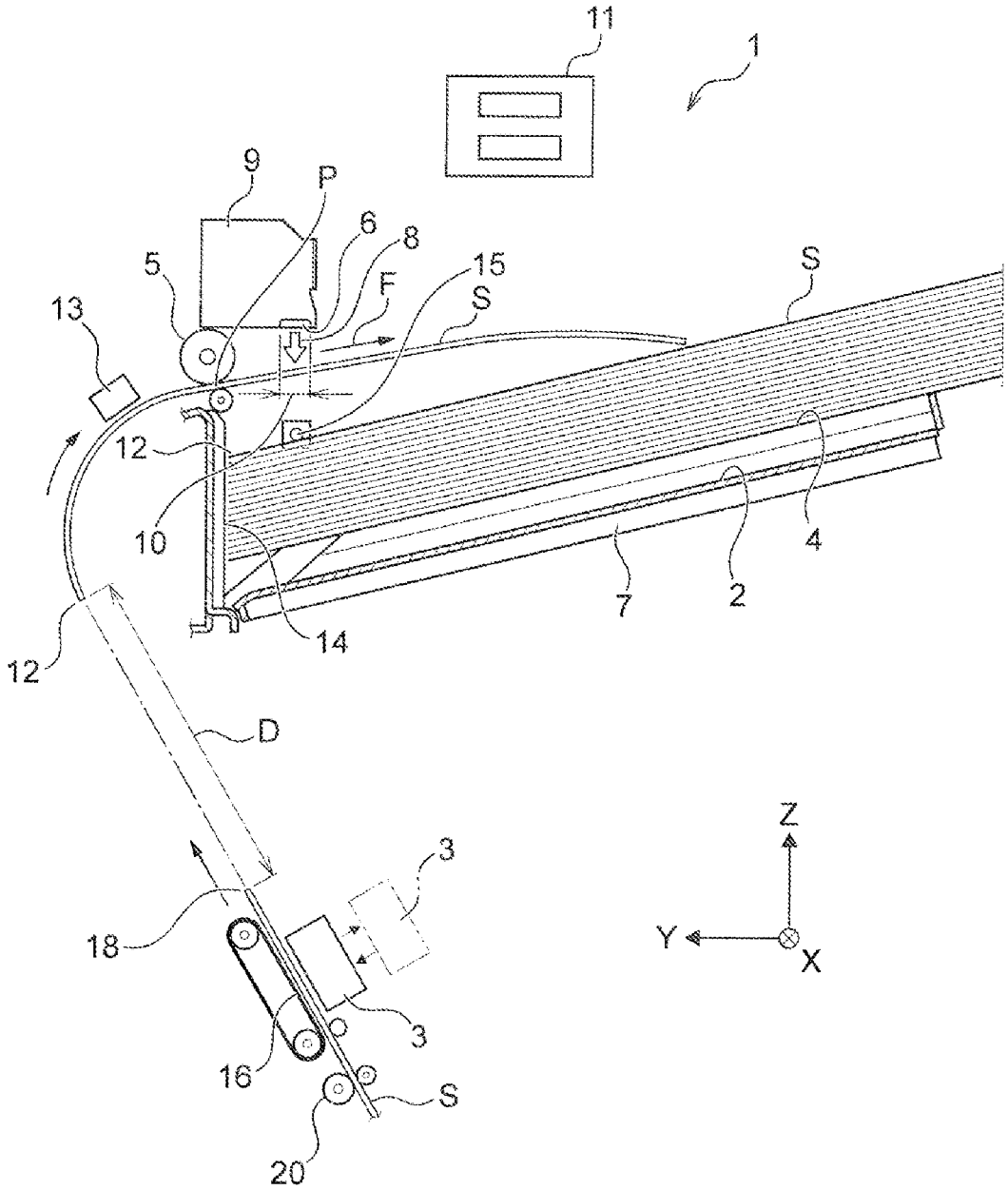
FIG. 3 is an enlarged cross-sectional side view of the main portion of Exemplary Embodiment 1.

As illustrated in FIG. 1 to FIG. 3, the recording device 1 according to the present exemplary embodiment includes a recording unit 3 (FIG. 3) configured to perform recording on a medium S, a medium discharge unit 5 (FIG. 2, FIG. 3) configured to discharge the medium S subjected to recording by the recording unit 3, a placement unit 7 at which the medium S discharged by the medium discharge unit 5 is placed, an air blowing unit 9 configured to blow air from above toward the medium S discharged from the medium discharge unit 5, and a control unit 11 (FIG. 3) configured to control the air blowing unit 9.

The control unit 11 includes a CPU (not illustrated), and a non-volatile memory (not illustrated), and performs various types of control including feeding, transporting, recording, and discharging of the medium in the recording device 1. The non-volatile memory (not illustrated) included in the control unit 11 stores programs, parameters, and the like for performing the various types of control.

The control unit 11 is configured to accept information of an interval D (FIG. 3) between a preceding medium S1 and a following medium S2 that are to be discharged from a discharge position P of the medium discharge unit 5 to the placement unit 7, and configured to attenuate the air blowing by the air blowing unit 9 based on the information of the interval D when the preceding medium S1 is discharged from the discharge position P. Specifically, when the interval D is large enough to hinder the slipping down, the air blowing by the air blowing unit 9 is attenuated.

As illustrated in FIG. 3, the recording unit 3 discharges ink to the medium S transported by a transport path, and performs recording. A reference sign 16 is a belt-type platen. A reference sign 20 is a pair of transport rollers provided in the transport path. A plurality of pairs of transport rollers are disposed along the transport path, but the other pairs of transport rollers are omitted from illustration. The air blowing unit 9 suppresses deformation such as curl by applying air to the medium S. The medium discharge unit 5 is constituted by the pair of discharge rollers. A nip position of the pair of discharge rollers is the discharge position P for discharging the medium S, which will be described below.

Air Blowing Unit

As illustrated in FIG. 1, in the present exemplary embodiment, the air blowing unit 9 includes two air blowing units 91 and 92 so as to apply air to, of the medium S discharged, positions on both sides in the X-axis direction in a medium width (in the X-axis direction) intersecting a discharge direction F with the central portion of the medium S interposed between the positions on both sides. Note that the number of air blowing units included in the air blowing unit 9 is not limited to two. In one air blowing unit 9, one air blowing unit may be disposed at the central portion, or three or more air blowing units may be disposed.

In FIG. 2, a reference sign 10 indicates an air blowing region of the air blowing unit 9. The air blowing region 10 is a region corresponding to the air blowing port 6 of the air blowing unit 9. When the medium S discharged from the medium discharge unit 5 passes through the air blowing region 10, air 8 blown out from the air blowing port 6 of the air blowing unit 9 hits the medium S from above, and thus, deformation of curl or the like of the medium S is suppressed.

Placement Unit

The placement unit 7 of the recording device 1 is inclined such that a downstream side in the discharge direction F (a −Y direction) in which the medium S is discharged is positioned, in a vertical direction, above an upstream side in the discharge direction F. That is, as illustrated in FIG. 2, the placement surface 2 of the placement unit 7 is inclined at an angle θ.

After the medium S drops onto the placement surface 2, the medium S slips down on the inclined placement surface 2 due to its own weight, and a trailing end 12 of the medium S comes into contact with an alignment portion 14 to align a position of the trailing end 12 (FIG. 3). The alignment portion 12 is a flat wall.

As illustrated in FIG. 1, the placement surface 2 is provided with a rib 4 extending so as to protrude upward from the placement surface 2 along the discharge direction F at a position corresponding to the central portion of the medium S placed. When the medium S is placed on the placement surface 2, the central portion is lifted by the rib 4, and both sides thereof take postures so as to come into contact with the placement surface 2.

In the present exemplary embodiment, as illustrated in FIG. 2 and FIG. 3, the medium detection unit 13 positioned upstream of the discharge position P in the discharge direction F is provided. The medium detection unit 13 detects the leading end 18 and the trailing end 12 of the medium S transported.

The medium detection unit 13 is constituted by an optical sensor configured to detect the passage of the leading end 18 and the trailing end 12 of the medium S.

Control Unit, Interval

As described above, the control unit 11 accepts information of the interval D (FIG. 3) between the preceding medium S1 and the following medium S2 that are to be discharged from the discharge position P.

In the present exemplary embodiment, as the information of the interval D, information about the passage of the leading end 18 and the trailing end 12 of the medium S detected by the medium detection unit 13 is used. That is, the control unit 11 is configured to accept the information about the passage of the leading end 18 and the trailing end 12 of the medium S, and to calculate and obtain the interval D from the information.

Note that the information of the interval D is not limited to that described above. The medium detection unit 13 may calculate and obtain the interval D from the information about the passage of the leading end 18 and the trailing end 12 of the medium S, and the control unit 11 may accept the obtained interval D.

Information of Interval

The information of the interval D means information that can be used to determine a change in size of the interval between the preceding medium S1 and the following medium S2 that are discharged from the discharge position P of the medium discharge unit 5 to the placement unit 7.

Thus, all information that can be used to determine the change in size of the interval is included, and the information is not limited to direct information of the interval D obtained by using the medium detection unit 13. Indirect information such as, for example, flushing that causes the interval D to change, an operation type such as a quiet transport mode, or the like is included.

An ink jet printer performs flushing to prevent nozzle clogging. In this case, since the recording by the recording unit 3 is interrupted during the flushing operation, the transport of the medium S before the recording is stopped in the transport path. On the other hand, since the medium S subjected to recording is transported without stopping, the interval between the preceding medium S1 and the following medium S2 is increased in a portion where the flushing operation has been performed, which tends to hinder the slipping down. Thus, when the flushing operation is performed, the flushing operation itself can be used as the information of the interval D. Specific description of this point will be described later.

In addition, since a quiet transport mode slows a transport velocity compared to a normal transport mode, the interval between the preceding medium and the following medium that are discharged from the discharge position increases, which tends to hinder the slipping down. Thus, when the quiet transport mode is performed, the quiet transport mode itself can be used as the information of the interval D. Specific description of this point will be described later.

Control Unit, Attenuating Air Blowing

The control unit 11 is configured to attenuate the air blowing by the air blowing unit 9 based on the accepted information of the interval D when the preceding medium S1 is discharged from the discharge position P of the medium discharge unit 5 to the placement unit 7. Specifically, when the interval D accepted by the control unit 11 is an interval Db large enough to hinder the slipping down, the air blowing is attenuated.

Here, the interval Db is set as a set value Db by performing, in advance, data collection for checking a state in which the slipping down is hindered. Further, the control unit 11 is configured to attenuate the air blowing when the control unit 11 determines that the accepted interval D has exceeded the set value Db. Here, the number of the set values Db need not be one, and a plurality of the set values Db may be set in a stepwise manner. Alternatively, a user may be configured to adjust and change the set value Db.

Furthermore, "attenuating the air blowing" means that the air blowing amount is made to be less than the air blowing amount of the air blowing unit 9 at a point in time when the control unit 11 performs the determination of the set value Db. The degree to which the air blowing amount is reduced is set from a viewpoint of ensuring that the slipping down is not hindered after data collection for checking is performed in advance. Note that "attenuating the air blowing" includes stopping the air blowing.

Procedure of Control

Figure 4:
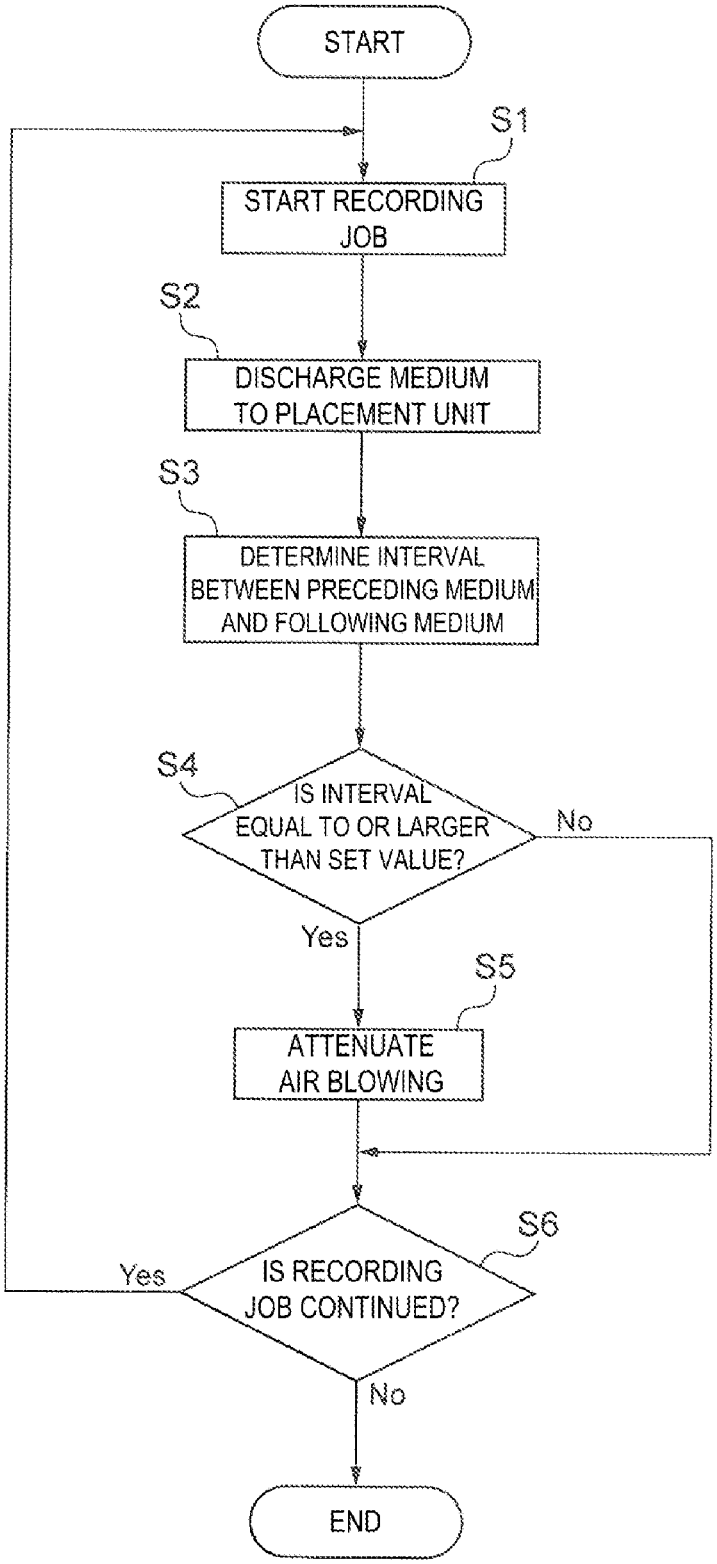
FIG. 4 is a flowchart illustrating an air blowing control procedure of Exemplary Embodiment 1.

An air blowing control method of the recording device 1 according to the present exemplary embodiment will be described based on FIG. 4.

When a recording job starts in step S1, the medium S is transported in the transport path with a predetermined interval set in advance. The air 8 blown from the air blowing unit 9 is blown by a predetermined air blowing amount set in advance.

When the first medium S passes through a recording execution region of the recording unit 3, ink is ejected and recording is performed. When recording of the first medium is completed and the first medium passes through the recording execution region, recording is performed on the second medium, which is the following medium. This operation is repeated for the third medium, the fourth medium, and the like, and thus, the recording is continuously performed on a plurality of media.

In step S2, the recorded medium is sequentially discharged from the discharge position P of the medium discharge unit 5 through the air blowing region 10 of the air blowing unit 9 to the placement unit 7. Passing through the air blowing region 10 suppresses curl of the medium S, which is a paper sheet that has absorbed ink due to the air blowing from the air blowing unit. The discharged medium S drops onto the placement unit 7 due to its own weight and the air blowing from the air blowing unit 9. After the medium S drops onto the placement surface 2 of the inclined placement unit 7, the medium S slips down on the placement surface 2, and the trailing end 12 of the medium S is brought into contact with the alignment portion 14 to align the position of the trailing end (FIG. 3).

When the medium S slips down on the placement surface 2, the following medium S2 is fed out in a nipped state by the medium discharge unit 5, and the leading end 18 of the following medium S2 passes through the air blowing region 10 of the air blowing unit 9. In this state, the air 8 blown out from the air blowing unit 9 hits the following medium S2, and the amount of air hitting the preceding medium S1 that has dropped onto the placement unit 7 decreases. In the state in which the amount of air hitting the preceding medium S1 is reduced, the preceding medium S1 slips down on the placement surface 2 due to its own weight.

During this time, the control unit 11 accepts the information of the interval D.

In step S3, whether the interval D between the preceding medium S1 and the following medium S2 is equal to or larger than the set value Db is determined.

In step S4, when the determination is YES, processing proceeds to step S5, and the air blowing by the air blowing unit 9 is attenuated. That is, the air blowing amount is set to such an air blowing amount that the state in which the preceding medium S1 slips down on the placement surface 2 is not hindered. The state in which the air blowing is attenuated is returned to the original air blowing amount after the time it takes for the preceding medium S1 to slip down on the placement surface 2 to the position of the alignment portion 14 has elapsed. The time of slipping down is checked and set in advance.

Subsequently, the processing proceeds to step S6 to determine whether to continue the recording job, and when the recording job is not continued (NO), the processing is ended. When the recording job is continued in step S6 (YES), the processing returns to step S1.

In step S4, when the determination is NO, the processing proceeds to step S6.

Additionally, in the present exemplary embodiment, the control unit 11 is configured to attenuate the air blowing by the air blowing unit 9 when the last medium S is discharged from the discharge position P to the placement unit 7.

Here, the "last medium" means a medium that is the last one to be discharged to the placement unit 7 in one recording job. Note that, when the first recoding job and the following second recording job are performed in a series, and when the interval D between the last medium in the first recording job and the first medium in the second recording job does not change, the "last medium" described here does not include the last one medium in the first recording job, and refers to the last one medium in the second recording job.

Modified Example 1 of Exemplary Embodiment 1

In the above description, direct information of the interval D obtained by calculating from the information of the passage of the leading end 18 and the trailing end 12 of the medium S detected by the medium detection unit 13 is used for the information of the interval D.

Hereinafter, a case where indirect information other than the direct information obtained by using the medium detection unit 13 is used as the information of the interval D will be described.

First, Modified Example 1 will be described. The control unit 11 can change a discharge velocity of the medium S discharged from the discharge position P from a first velocity V1 to a second velocity V2 slower than the first velocity V1. Additionally, the control unit 11 is configured to attenuate the air blowing by the air blowing unit 9 when the medium S is discharged at the second velocity V2. Note that examples of a case where the medium S is discharged at the second velocity being slower include a case where transfer to the medium S is likely to occur, a case where the transport velocity is reduced in order to suppress curl of the medium S, and a case where noise reduction needs to be achieved.

When the discharge velocity of the medium S is changed to the second velocity V2 slower than the first velocity V1, the interval D between the media S increases. That is, changing the discharge velocity of the medium S to the low velocity causes the interval D to change, which can be used as information for determining the change in size of the interval D. Modified Example 1 is configured to attenuate the air blowing by using the change in discharge velocity of the medium S as the information of the interval D. When the discharge velocity of the medium S is returned to the first velocity from the second velocity, the control unit 11 accepts the signal and returns the air blowing by the air blowing unit 9 to the original air blowing.

Modified Example 2 of Exemplary Embodiment 1

Modified Example 2 will be described.

The control unit 11 includes a quiet transport mode where quietness is enhanced compared to the normal transport mode for transporting the medium S. Then, the air blowing unit 9 is configured to attenuate the air blowing when the quiet transport mode is selected.

In the quiet transport mode, a velocity of transporting the medium S is slower than the normal transport mode, and thus, the interval D increases. In other words, changing to the quiet transport mode causes the interval D to change, which can be used as information for determining the change in size of the interval D. Modified Example 2 is configured to attenuate the air blowing by using changing to the quiet transport mode as the information of the interval D. When the mode is returned to the normal transport mode from the quiet transport mode, the control unit 11 accepts the signal and returns the air blowing by the air blowing unit 9 to the original air blowing.

Modified Example 3 of Exemplary Embodiment 1

Modified Example 3 will be described.

As illustrated in FIG. 3, the recording unit 3 is movable to a recording position (solid line position) for performing recording on the medium S, and a flushing position (dashed line position) for performing flushing. Additionally, the control unit 11 is configured to attenuate the air blowing by the air blowing unit 9 when the recording unit 3 performs the flushing.

When the recording unit 3 moves to the flushing position, the interval D increases as described above. In other words, performing the flushing causes the interval D to change, which can be used as information for determining the change in size of the interval D. Modified Example 3 is configured to attenuate the air blowing by using performing the flushing as the information of the interval D. When the flushing operation is completed, the control unit 11 accepts the signal and returns the air blowing by the air blowing unit 9 to the original air blowing.

Figure 5:
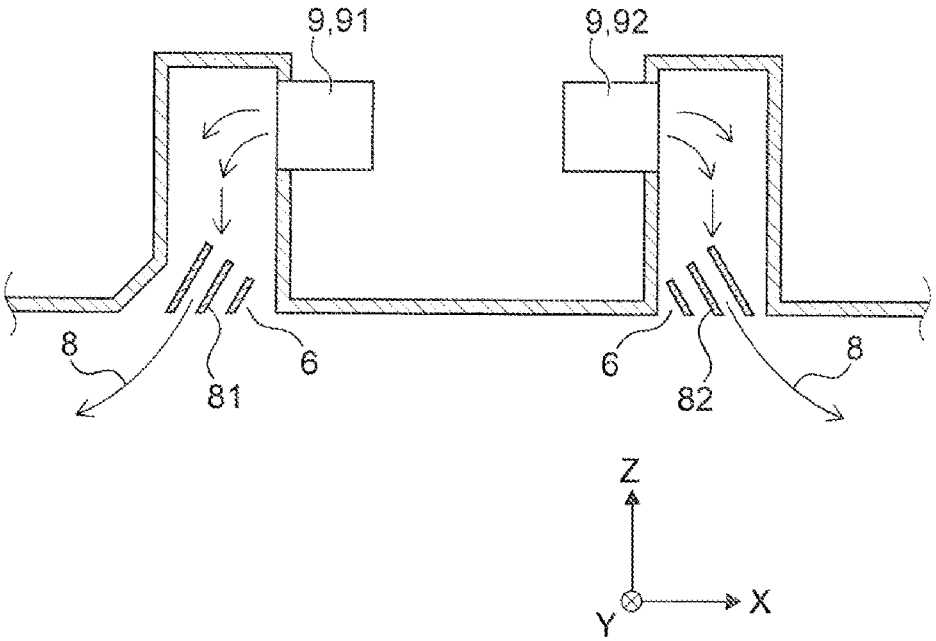
FIG. 5 is a schematic view of an air blowing unit of Exemplary Embodiment 1.

Additionally, as illustrated in FIG. 5, in the present exemplary embodiment, the air blowing units 91 and 92 respectively include air blowing direction changing members 81 and 82 configured to change directions of the air blowing to the medium S. Here, the air blowing direction changing members 81 and 82 are constituted by louvers. Specifically, the air blowing direction changing member 81 provided at the air blowing port 6 of the air blowing unit 91 can continuously change a blowing-out direction of the air 8 from the −Z direction in the −X direction. The air blowing direction changing member 82 provided at the air blowing port 6 of the air blowing unit 92 can continuously change the blowing-out direction of the air 8 from the −Z direction to the +X direction.

In the present exemplary embodiment, the air blowing direction changing members 81 and 82 appropriately change positions where the air is applied according to the size of the medium S. Furthermore, the suppression effect of curl is appropriately adjusted.

In other words, the air blowing direction changing members 81 and 82 can function as a shutter of the air blowing port 6 of the air blowing unit 9, and thus, attenuating the air blowing from the air blowing unit 9, and returning the air blowing to the original air blowing can be easily performed.

Additionally, as illustrated in FIG. 3, in the present exemplary embodiment, a stacking height detection unit 15 installed at a constant height from the placement surface 2 of the placement unit 7 and configured to detect the stacking height of the medium S is provided. The stacking height detection unit 15 is disposed at a position below the discharge position P in a vertical height direction, and is provided at a position where the air blowing unit 9 overlaps the air blowing region 10 where air is blown to the medium S in the discharge direction F.

Here, in the expression of being provided at a position overlapping the air blowing region 10 where the air blowing unit 9 blows air to the medium S in the discharge direction F, the overlapping position means a position where the air blowing region 10 and the stacking height detection unit 15 seem to overlap each other when the recording device 1 is viewed in a direction (the +X direction) intersecting the discharge direction F (the −Y direction). Note that strictness is not required for the degree to which the air blowing region 10 and the stacking height detection unit 15 "seem to overlap each other" as described above, and the air blowing region 10 and the stacking height detection unit 15 may be shifted from each other within a range of preventing erroneous detection of the stacking height detection unit 15.

The stacking height detection unit 15 is provided to grasp whether a height of the medium S stacked has become a specified height. The stacking height detection unit 15 may also be referred to as a full stack sensor (FS). Here, an optical sensor including a light-emitting unit and a light-receiving unit is used as the stacking height detection unit 15. The fact that the stacked medium S blocks light beams emitted from the light-emitting unit of the optical sensor in the X-axis direction allows the fact that the stacking height has reached the specified height to be grasped.

FIG. 1 illustrates a state slightly before the stacking height of the medium S reaches the specified height. The stacking height detection unit 15 in FIG. 1 is a portion of the light-emitting unit, and the light-receiving unit is attached on the opposite side to the light-emitting unit with the stacking surface 2 interposed between the light-emitting unit and the light-receiving unit.

Additionally, in the present exemplary embodiment, the stacking height detection unit 15 is configured to detect the stacking height of the media S in a predetermined period of time after the medium detection unit 13 detects the trailing end 12 of the preceding medium S1. Here, detecting the stacking height of the media S in the predetermined period of time means detecting the medium S a plurality of times in the predetermined period of time excluding cases where the medium S is instantaneously detected.

Since the medium S discharged from the discharge position P of the medium discharge unit 5 passes through the detection region of the stacking height detection unit 15, that is, light beams when the medium S drops down on the placement unit 7, the stacking height detection unit 15 instantaneously detects that the medium S "exists". However, the detection is not performed by detecting the stacking height of the media S, but the passage of the medium S is only detected. Thus, when the instantaneous detection is excluded, the stacking height detection unit 15 causes erroneous detection in the detection of the stacking height.

Figure 6:
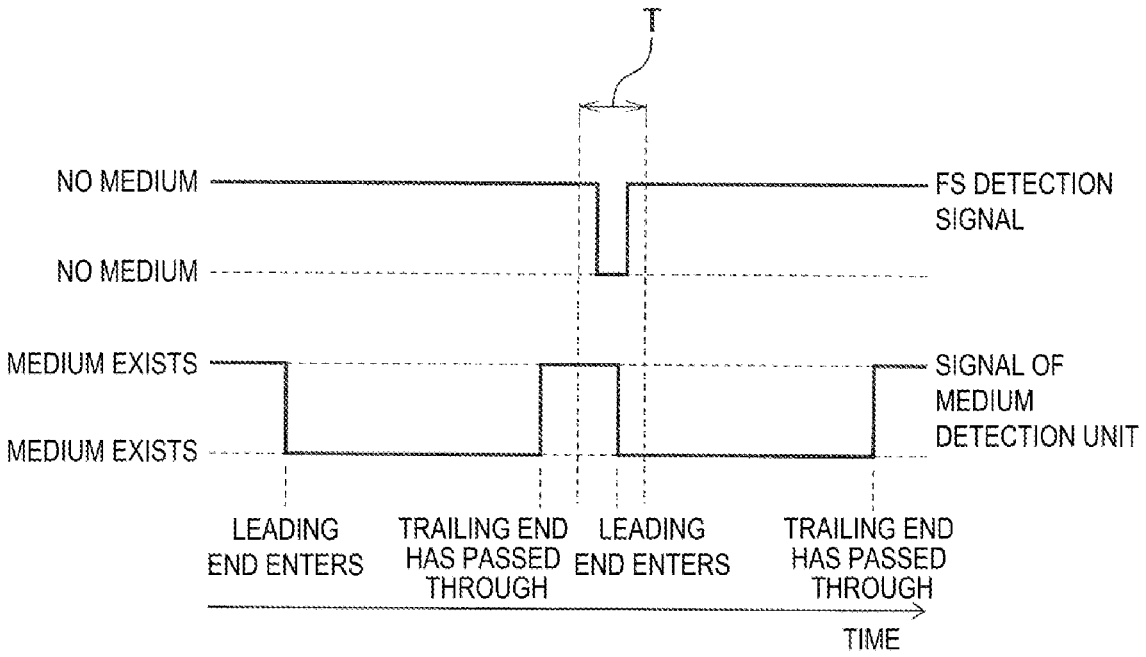
FIG. 6 is a timing chart for explaining a detecting period by a stacking height detection unit of Exemplary embodiment 1.

In the present exemplary embodiment, as illustrated in FIG. 6, the stacking height detection unit 15 detects the stacking height of the media S in a predetermined period of time T after the medium detection unit 13 detects the trailing end 12 of the preceding medium S1. In other words, the detecting period has a sufficient time width. Thus, the instantaneous detection, such as just detecting the passage of the medium S, is excluded to prevent erroneous detection. In FIG. 6, an FS detection signal is a detection signal of the stacking height detection unit 15.

Additionally, in the present exemplary embodiment, the predetermined period of time is configured such that the predetermined period of time is from when the medium detection unit 13 detects the trailing end 12 of the preceding medium S1 to when the leading end 18 of the following medium S2 blocks the air blowing unit 9. Here, the expression of "until when the leading end 18 of the following medium S2 blocks the air blowing unit 9" is used to mean any point in time until the leading end 18 of the following medium S2 reaches one end of the air blowing region 10 of the air blowing unit 9.

That is, a configuration is adopted in which the stacking height is detected when the air blowing unit 9 presses the preceding medium S1 and the stacking height is appropriately detected.

Modified Example of Predetermined Period of Time

Further, the predetermined period of time may be longer than the time it takes for the medium dropping after being discharged from the discharge position of the medium discharge unit to pass through the detection region of the stacking height detection unit. Here, the "longer period of time" in the expression of the period of time being longer than the time it takes for the dropping medium S to pass through the detection region of the stacking height detection unit 15 is set from the perspective of preventing the erroneous detection after data collection for checking is performed in advance for the medium S to be used.

The predetermined period of time is longer than the time it takes for the medium S dropping after being discharged from the discharge position P of the medium discharge unit 5 to pass through the detection region of the stacking height detection unit 15, and thus, the erroneous detection is suppressed except for the case where the passage of the medium S is only detected.

Description Related to Advantageous Effects of Exemplary Embodiment (1) According to the present exemplary embodiment, the control unit 11 is configured to accept information of the interval D between the preceding medium S1 and the following medium S2 that are to be discharged from the discharge position P to the placement unit 7, and configured to attenuate the air blowing by the air blowing unit 9 based on the information of the interval D when the preceding medium S1 is discharged from the discharge position P. In this way, when the interval D is increased to such an extent that the slipping down is hindered, the air blowing is attenuated. Thus, deterioration in stackability due to the slipping down of the preceding medium S1 on the placement surface 2 being hindered can be suppressed.

(2) Further, according to the present exemplary embodiment, the medium detection unit 13 configured to detect the leading end 18 and the trailing end 12 of the medium S is positioned upstream of the discharge position P in the discharge direction F. Thus, the information of the interval D can be easily obtained by the medium detection unit 13. Thus, a timing of attenuating the air blowing can be appropriately set.

(3) Further, according to the present exemplary embodiment, when the last medium is discharged, the air blowing by the air blowing unit 9 is attenuated. In this way, even when the interval D until the first medium S of the next recording job is discharged becomes large, deterioration in stackability due to the slipping down of the preceding medium S1 on the placement surface 2 being hindered can be suppressed.

(4) Further, according to the present exemplary embodiment, when the medium S is discharged with the discharge velocity of the medium S changed from the first velocity to the second velocity slower than the first velocity, the interval D becomes large, but the air blowing by the air blowing unit 9 is attenuated. Thus, deterioration in stackability due to the slipping down of the preceding medium S1 on the placement surface 2 being hindered can be suppressed.

(5) Further, according to the present exemplary embodiment, a velocity of transporting the medium in the quiet transport mode is slower than a velocity of transporting the medium in the normal transport mode, and the interval D becomes large, but when the quiet transport mode is selected, the air blowing by the air blowing unit 9 is attenuated. Thus, deterioration in stackability due to the slipping down of the preceding medium S1 on the placement surface 2 being hindered can be suppressed.

(6) Further, according to the present exemplary embodiment, when the recording unit 3 performs flushing, the air blowing by the air blowing unit 9 is attenuated. Thus, deterioration in stackability due to the slipping down of the preceding medium S1 on the placement surface 2 being hindered can be suppressed.

Further, when the recording unit 3 performs flushing, the recording unit 3 moves to a flushing position, and thus, electric power for the movement is required. According to the present exemplary embodiment, when the recording unit 3 performs flushing, the air blowing by the air blowing unit 9 is attenuated, and thus, power consumption can be simultaneously suppressed.

(7) Further, according to the present exemplary embodiment, the air blowing unit 9 applies air to, of the medium S discharged, positions on both sides in the medium width direction intersecting the discharge direction F with the central portion of the medium S interposed between the positions on both sides. When curl is suppressed, it is preferable to apply air to both end sides in the width direction of the medium S. According to the present exemplary embodiment, even with such a configuration, deterioration in stackability due to the slipping down of the preceding medium S1 on the placement surface 2 being hindered can be suppressed.

(8) Further, according to the present exemplary embodiment, the air blowing direction changing members 81 and 82 can change the direction of the air blowing to the medium S. This makes it possible to appropriately change the positions where the air is applied according to the size of the medium S. Furthermore, the suppression effect of curl can be appropriately adjusted.

Furthermore, the air blowing direction changing members 81 and 82 can function as a shutter of the air blowing port 6 of the air blowing unit 9, and thus, can attenuate the air blowing of the air blowing unit 9.

(9) Further, according to the present exemplary embodiment, the stacking height detection unit 15 is disposed at a position below the discharge position P in the vertical height direction, the position overlapping the air blowing region 10 where the air blowing unit 9 blows air to the medium S in the discharge direction F. This makes it possible to detect the medium S at the position where the medium S is pressed against the placement unit 7 due to the air 8 from the air blowing unit 9, that is, at the position where curl of the medium S is suppressed, and thus, it is possible to more reliably detect whether the placement unit 7 is full.

(10) Further, according to the present exemplary embodiment, the stacking height detection unit 15 detects the stacking height of the medium S in the predetermined period T after the medium detection unit 13 detects the trailing end 12 of the preceding medium S1, that is, the detection period has a sufficient time width. Thus, instantaneous detection of the medium S such as detection of only the passage of the medium S can be excluded to prevent erroneous detection.

(11) Further, according to the present exemplary embodiment, the predetermined period is set to until the leading end 18 of the following medium S2 blocks the air blowing unit 9, the stacking height can be appropriately detected because the stacking height is detected when the air blowing unit 9 presses the preceding medium S1.

(12) Further, according to the present exemplary embodiment, the predetermined period is longer than time it takes for the medium S dropping after being discharged from the discharge position P of the medium discharge unit 5 to pass through the detection region of the stacking height detection unit 15, thereby suppressing erroneous detection.

Other Exemplary Embodiments

The recording device and the air blowing control method of the recording device according to the present disclosure is based on the configuration of the exemplary embodiment described above. However, as a matter of course, changes, omissions, and the like may be made to a partial configuration without departing from the gist of the disclosure of the present application.

In the above-described exemplary embodiment, attenuating the air blowing of the air blowing unit 9 has been described for a state in which the air blowing is not actively stopped, but the control unit 11 may be configured such that the air blowing is stopped when the interval D exceeds the set value. Here, the set value is predetermined as an interval when the air blowing should be stopped. Alternatively, a user may appropriately determine the set value.

Due to this, the control unit 11 stops the air blowing when the interval D exceeds the set value, and thus, the occurrence of a case where the preceding medium S1 cannot slip down on the placement surface 2 can be suppressed.

What is claimed is:

1. A recording device comprising:

a recording unit configured to perform recording on a medium;

a medium discharge unit configured to discharge the medium recorded by the recording unit;

a placement unit at which the medium discharged by the medium discharge unit is placed, the placement unit being inclined with a downstream side in a discharge direction in which the medium is discharged being positioned, in a vertical direction, above an upstream side in the discharge direction;

an air blowing unit configured to blow air from above toward the medium discharged from the medium discharge unit; and a control unit configured to control the air blowing unit, wherein the control unit is configured to attenuate air blowing by the air blowing unit, based on information of an interval between a preceding medium and a following medium that are to be discharged from a discharge position of the medium discharge unit to the placement unit, when the preceding medium is discharged from the discharge position.

2. The recording device according to claim 1, wherein when the interval exceeds a set value, the control unit stops the air blowing.

3. The recording device according to claim 1, further comprising:

a medium detection unit positioned upstream of the discharge position in the discharge direction and configured to detect a leading end and a trailing end of the medium.

4. The recording device according to claim 1, wherein the control unit attenuates the air blowing by the air blowing unit when a last medium in a recording job is discharged.

5. The recording device according to claim 1, wherein the control unit:

is configured to change a discharge velocity of the medium discharged from the discharge position from a first velocity to a second velocity that is slower than the first velocity and attenuates the air blowing by the air blowing unit when the medium is discharged at the second velocity.

6. The recording device according to claim 1, wherein the control unit:

includes a quiet transport mode where quietness is enhanced compared to a normal transport mode for transporting the medium and attenuates the air blowing by the air blowing unit when the quiet transport mode is selected.

7. The recording device according to claim 1, wherein the recording unit is movable to a recording position where recording is performed on the medium, and a flushing position where flushing is performed and the control unit attenuates the air blowing by the air blowing unit when the recording unit performs the flushing.

8. The recording device according to claim 1, wherein the air blowing unit applies air to positions on both sides of the medium in a medium width direction intersecting the discharge direction with a central portion of the medium interposed between the positions on both sides.

9. The recording device according to claim 1, wherein the air blowing unit includes an air blowing direction changing member configured to change a direction in which air is blown to the medium.

10. The recording device according to claim 1, further comprising:

a stacking height detection unit configured to detect a stacking height of the medium stacked, wherein the stacking height detection unit is provided at a position that is below the discharge position in a vertical height direction and that overlaps, in the discharge direction, an air blowing region where the air blowing unit blows air to the medium.

11. The recording device according to claim 10, further comprising:

a medium detection unit positioned upstream of the discharge position in the discharge direction and configured to detect a leading end and a trailing end of the medium, wherein the stacking height detection unit detects the stacking height of the medium in a predetermined period of time after the medium detection unit detects the trailing end of the preceding medium.

12. The recording device according to claim 11, wherein the predetermined period of time is from when the medium detection unit detects the trailing end of the preceding medium until when the leading end of the following medium blocks the air blowing unit.

13. The recording device according to claim 11, wherein the predetermined period of time is longer than time that it takes for the medium dropping after being discharged from the discharge position of the medium discharge unit to pass through a detection region of the stacking height detection unit.

14. An air blowing control method of a recording device, the recording device including:

a recording unit configured to perform recording on a medium, a medium discharge unit configured to discharge the medium recorded by the recording unit, a placement unit at which the medium discharged by the medium discharge unit is placed, the placement unit being inclined with a downstream side in a discharge direction in which the medium is discharged being positioned, in a vertical direction, above an upstream side in the discharge direction, an air blowing unit configured to blow air from above toward the medium discharged from the medium discharge unit, and a control unit configured to control the air blowing unit, the air blowing control method comprising:

accepting, by the control unit, information of an interval between a preceding medium and a following medium that are to be discharged from a discharge position of the medium discharge unit to the placement unit; and attenuating air blowing by the air blowing unit, based on the information of the interval, when the preceding medium is discharged from the discharge position.

* * * * *